US009068251B2

(12) United States Patent
Eβer et al.

(10) Patent No.: US 9,068,251 B2
(45) Date of Patent: Jun. 30, 2015

(54) ALLOY FOR DIRECTIONAL SOLIDIFICATION AND COMPONENT MADE OF STEM-SHAPED CRYSTALS

(75) Inventors: Winfried Eβer, Bochum (DE); Dirk Goldschmidt, Moers, DE (US); Christopher R. Hanslits, Zuni, VA (US); Michael Ott, Mülheim an der Ruhr (DE); Uwe Paul, Ratingen (DE); Ursula Pickert, Mülheim an der Ruhr (DE); Russell G. Vogt, Yorktown, VA (US)

(73) Assignees: SIEMENS AKTIENGESELLSCHAFT, München (DE); HOWMET CORPORATION, Cleveland, OH (US)

( * ) Notice: Subject to any disclaimer, the term of this patent is extended or adjusted under 35 U.S.C. 154(b) by 461 days.

(21) Appl. No.: 13/502,451

(22) PCT Filed: Oct. 20, 2009

(86) PCT No.: PCT/EP2009/063737

§ 371 (c)(1),
(2), (4) Date: Apr. 17, 2012

(87) PCT Pub. No.: WO2011/047714

PCT Pub. Date: Apr. 28, 2011

(65) Prior Publication Data

US 2012/0201713 A1 Aug. 9, 2012

(51) Int. Cl.
*C22C 19/05* (2006.01)

(52) U.S. Cl.
CPC ..... *C22C 19/055* (2013.01); *C22C 19/051* (2013.01)

(58) Field of Classification Search
None
See application file for complete search history.

(56) References Cited

U.S. PATENT DOCUMENTS

| | | | | |
|---|---|---|---|---|
| 3,807,993 | A * | 4/1974 | Dalai et al. | 420/448 |
| 6,024,792 | A | 2/2000 | Bieler | |
| 6,171,417 | B1 * | 1/2001 | Kawai et al. | 148/675 |
| 6,231,692 | B1 | 5/2001 | Corrigan | |
| 2003/0103862 | A1 * | 6/2003 | Bouse et al. | 420/448 |
| 2004/0200549 | A1 | 10/2004 | Cetel | |
| 2008/0260572 | A1 | 10/2008 | Arrell | |
| 2008/0304974 | A1 * | 12/2008 | Marshall et al. | 416/223 R |
| 2010/0080729 | A1 * | 4/2010 | Biondo et al. | 420/448 |

FOREIGN PATENT DOCUMENTS

| | | | |
|---|---|---|---|
| DE | 2333775 | | 1/1975 |
| EP | 0486489 | B1 | 11/1994 |
| EP | 0412397 | B1 | 3/1998 |
| EP | 0892090 | A1 | 1/1999 |
| EP | 0786017 | B1 | 3/1999 |
| EP | 0855449 | B1 | 8/2000 |
| EP | 1306454 | A1 | 5/2003 |
| EP | 1319729 | A1 | 6/2003 |
| EP | 1204776 | B1 | 6/2004 |
| EP | 1329527 | B1 | 5/2006 |
| WO | WO 9967435 | A1 | 12/1999 |
| WO | WO 0044949 | A1 | 8/2000 |
| WO | WO 0109403 | A1 | 2/2001 |
| WO | WO 2004038056 | A1 | 5/2004 |
| WO | WO 2005061742 | A1 | 7/2005 |

* cited by examiner

*Primary Examiner* — George Wyszomierski

(57) ABSTRACT

A nickel-based superalloy is provided. Known nickel-based superalloys for producing components made of stem shaped single crystals do not provide sufficiently for grain boundary strength. The superalloy includes a low molybdenum content and very accurately adjusted values for elements having grain boundary strength and elements that precipitate in grain boundaries.

15 Claims, 2 Drawing Sheets

ALLOY FOR DIRECTIONAL SOLIDIFICATION AND COMPONENT MADE OF STEM-SHAPED CRYSTALS

CROSS REFERENCE TO RELATED APPLICATIONS

This application is the US National Stage of International Application No. PCT/EP2009/063737, filed Oct. 20, 2009 and claims the benefit thereof. All of the applications are incorporated by reference herein in their entirety.

FIELD OF INVENTION

The invention relates to an alloy which serves for the production of directionally solidified components, and to a component which has columnar crystals.

BACKGROUND OF INVENTION

For use in the high-temperature range, for example in the case of gas turbines, use is often made of nickel-based superalloys. To further increase the strength, use is made of single crystals or components having columnar grains.

What matters in the case of the components having the columnar grains is the grain boundary strength and the grain boundary precipitations or the presence of foreign elements (impurities) which deposit at the grain boundaries. These elements can have a considerable influence on the mechanical properties at the high temperatures.

WO 00/44949 discloses a nickel-based superalloy having a high molybdenum content.

U.S. Pat. No. 6,231,692 likewise discloses a nickel-based alloy having a high molybdenum content.

EP 1 329 527 B1 discloses a nickel-based superalloy in the case of which the elements zirconium and hafnium are added deliberately.

EP 0 855 449 B1 likewise discloses a minimal addition of zirconium.

However, these alloys have a low grain boundary strength and as a result have a negative effect on the overall strength of a component, or are insufficiently ductile owing to zirconium and hafnium.

Relatively small additions of certain elements can have negative effects on these properties of the alloy if they are exceeded.

However, it is highly complex to reduce the contents of such elements. A balance must therefore be found between costs and optimization of the properties of the alloy.

SUMMARY OF INVENTION

Therefore, it is an object of the invention to solve this problem.

The object is achieved by an alloy as claimed in the claims and by a component as claimed in the claims.

The dependent claims list further advantageous measures which can be combined with one another, as desired, in order to obtain further advantages.

The description and the figures show merely exemplary embodiments of the invention.

DETAILED DESCRIPTION OF INVENTION

Figure 1:
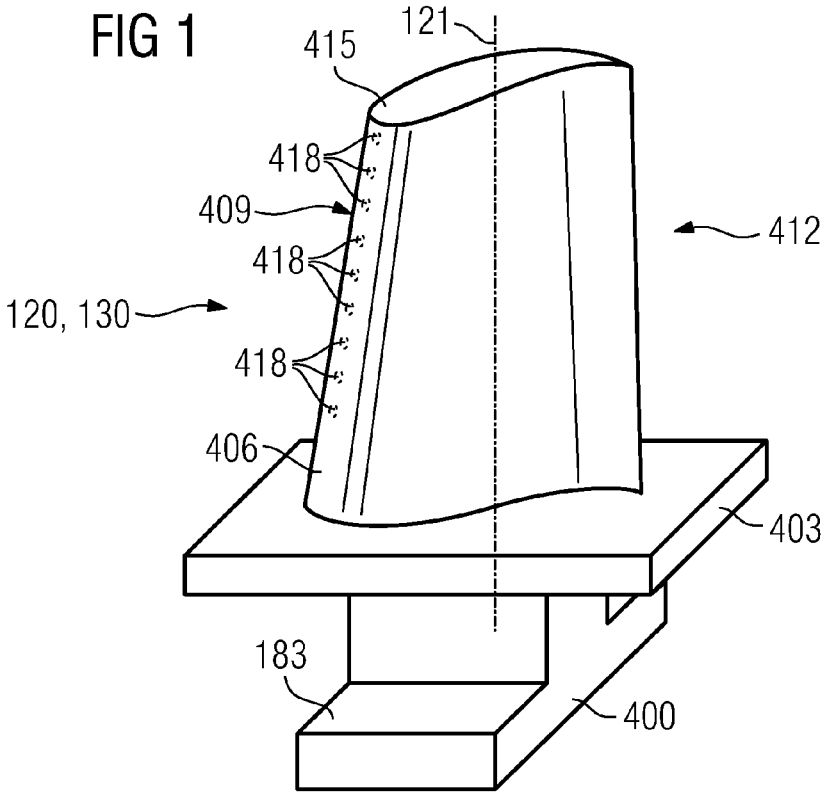
FIG. 1 shows a perspective view of a turbine blade or vane.

FIG. 1 shows a perspective view of a rotor blade 120 or guide vane 130 of a turbomachine, which extends along a longitudinal axis 121.

The turbomachine may be a gas turbine of an aircraft or of a power plant for generating electricity, a steam turbine or a compressor.

The blade or vane 120, 130 has, in succession along the longitudinal axis 121, a securing region 400, an adjoining blade or vane platform 403 and a main blade or vane part 406 and a blade or vane tip 415.

As a guide vane 130, the vane 130 may have a further platform (not shown) at its vane tip 415.

A blade or vane root 183, which is used to secure the rotor blades 120, 130 to a shaft or a disk (not shown), is formed in the securing region 400.

The blade or vane root 183 is designed, for example, in hammerhead form. Other configurations, such as a fir-tree or dovetail root, are possible.

The blade or vane 120, 130 has a leading edge 409 and a trailing edge 412 for a medium which flows past the main blade or vane part 406.

In the case of conventional blades or vanes 120, 130, by way of example solid metallic materials, in particular superalloys, are used in all regions 400, 403, 406 of the blade or vane 120, 130.

Superalloys of this type are known, for example, from EP 1 204 776 B1, EP 1 306 454, EP 1 319 729 A1, WO 99/67435 or WO 00/44949.

The blade or vane 120, 130 may in this case be produced by a casting process, by means of directional solidification, by a forging process, by a milling process or combinations thereof.

Workpieces with a single-crystal structure or structures are used as components for machines which, in operation, are exposed to high mechanical, thermal and/or chemical stresses.

Single-crystal workpieces of this type are produced, for example, by directional solidification from the melt. This involves casting processes in which the liquid metallic alloy solidifies to form the single-crystal structure, i.e. the single-crystal workpiece, or solidifies directionally.

In this case, dendritic crystals are oriented along the direction of heat flow and form either a columnar crystalline grain structure (i.e. grains which run over the entire length of the workpiece and are referred to here, in accordance with the language customarily used, as directionally solidified) or a single-crystal structure, i.e. the entire workpiece consists of one single crystal. In these processes, a transition to globular (polycrystalline) solidification needs to be avoided, since non-directional growth inevitably forms transverse and longitudinal grain boundaries, which negate the favorable properties of the directionally solidified or single-crystal component.

Where the text refers in general terms to directionally solidified microstructures, this is to be understood as meaning both single crystals, which do not have any grain boundaries or at most have small-angle grain boundaries, and columnar crystal structures, which do have grain boundaries running in the longitudinal direction but do not have any transverse grain boundaries. This second form of crystalline structures is also described as directionally solidified microstructures (directionally solidified structures).

Processes of this type are known from U.S. Pat. No. 6,024,792 and EP 0 892 090 A1.

The blades or vanes 120, 130 may likewise have coatings protecting against corrosion or oxidation e.g. (MCrAlX; M is at least one element selected from the group consisting of iron (Fe), cobalt (Co), nickel (Ni), X is an active element and stands for yttrium (Y) and/or silicon and/or at least one rare earth element, or hafnium (Hf)). Alloys of this type are known from EP 0 486 489 B1, EP 0 786 017 B1, EP 0 412 397 B1 or EP 1 306 454 A1.

The density is preferably 95% of the theoretical density.

A protective aluminum oxide layer (TGO=thermally grown oxide layer) is formed on the MCrAlX layer (as an intermediate layer or as the outermost layer).

The layer preferably has a composition Co-30Ni-28Cr-8Al-0.6Y-0.7Si or Co-28Ni-24Cr-10Al-0.6Y. In addition to these cobalt-based protective coatings, it is also preferable to use nickel-based protective layers, such as Ni-10Cr-12Al-0.6Y-3Re or Ni-12Co-21Cr-11Al-0.4Y-2Re or Ni-25Co-17Cr-10Al-0.4Y-1.5Re.

It is also possible for a thermal barrier coating, which is preferably the outermost layer, to be present on the MCrAlX, consisting for example of $ZrO_2$, $Y_2O_3$—$ZrO_2$, i.e. unstabilized, partially stabilized or fully stabilized by yttrium oxide and/or calcium oxide and/or magnesium oxide.

The thermal barrier coating covers the entire MCrAlX layer. Columnar grains are produced in the thermal barrier coating by suitable coating processes, such as for example electron beam physical vapor deposition (EB-PVD).

Other coating processes are possible, e.g. atmospheric plasma spraying (APS), LPPS, VPS or CVD. The thermal barrier coating may include grains that are porous or have micro-cracks or macro-cracks, in order to improve the resistance to thermal shocks. The thermal barrier coating is therefore preferably more porous than the MCrAlX layer.

Refurbishment means that after they have been used, protective layers may have to be removed from components 120, 130 (e.g. by sand-blasting). Then, the corrosion and/or oxidation layers and products are removed. If appropriate, cracks in the component 120, 130 are also repaired. This is followed by recoating of the component 120, 130, after which the component 120, 130 can be reused.

The blade or vane 120, 130 may be hollow or solid in form. If the blade or vane 120, 130 is to be cooled, it is hollow and may also have film-cooling holes 418 (indicated by dashed lines).

Figure 2:
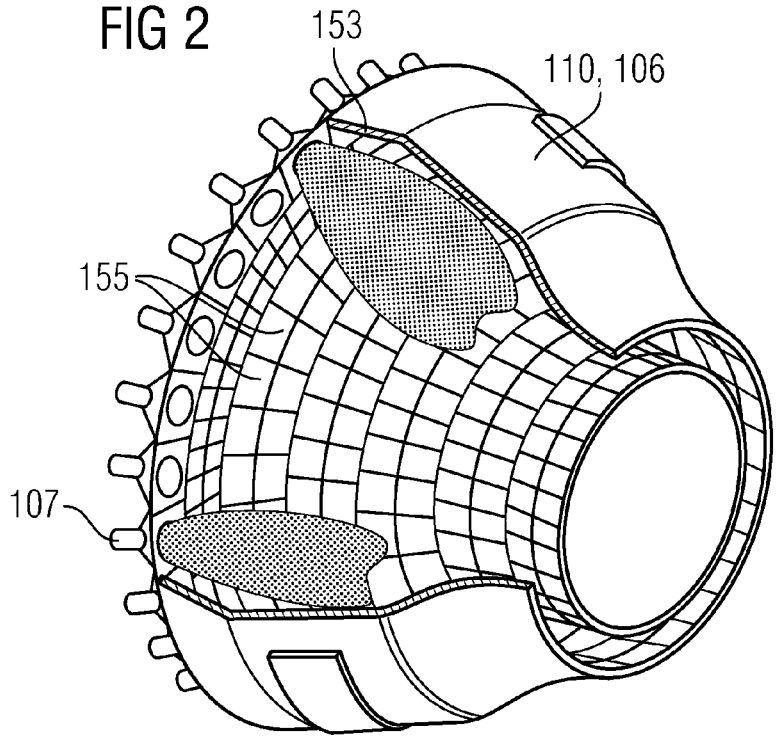
FIG. 2 shows a combustion chamber.

FIG. 2 shows a combustion chamber 110 of a gas turbine.

The combustion chamber 110 is configured, for example, as what is known as an annular combustion chamber, in which a multiplicity of burners 107, which generate flames 156, arranged circumferentially around an axis of rotation 102 open out into a common combustion chamber space 154. For this purpose, the combustion chamber 110 overall is of annular configuration positioned around the axis of rotation 102.

To achieve a relatively high efficiency, the combustion chamber 110 is designed for a relatively high temperature of the working medium M of approximately 1000° C. to 1600° C. To allow a relatively long service life even with these operating parameters, which are unfavorable for the materials, the combustion chamber wall 153 is provided, on its side which faces the working medium M, with an inner lining formed from heat shield elements 155.

On the working medium side, each heat shield element 155 made from an alloy is equipped with a particularly heat-resistant protective layer (MCrAlX layer and/or ceramic coating) or is made from material that is able to withstand high temperatures (solid ceramic bricks).

These protective layers may be similar to the turbine blades or vanes, i.e. for example MCrAlX: M is at least one element selected from the group consisting of iron (Fe), cobalt (Co), nickel (Ni), X is an active element and stands for yttrium (Y) and/or silicon and/or at least one rare earth element or hafnium (Hf). Alloys of this type are known from EP 0 486 489 B1, EP 0 786 017 B1, EP 0 412 397 B1 or EP 1 306 454 A1.

It is also possible for a, for example ceramic, thermal barrier coating to be present on the MCrAlX, consisting for example of $ZrO_2$, $Y_2O_3$—$ZrO_2$, i.e. unstabilized, partially stabilized or fully stabilized by yttrium oxide and/or calcium oxide and/or magnesium oxide.

Columnar grains are produced in the thermal barrier coating by suitable coating processes, such as for example electron beam physical vapor deposition (EB-PVD). Other coating processes are possible, e.g. atmospheric plasma spraying (APS), LPPS, VPS or CVD. The thermal barrier coating may include grains that are porous or have micro-cracks or macro-cracks, in order to improve the resistance to thermal shocks.

Refurbishment means that after they have been used, protective layers may have to be removed from heat shield elements 155 (e.g. by sand-blasting). Then, the corrosion and/or oxidation layers and products are removed. If appropriate, cracks in the heat shield element 155 are also repaired. This is followed by recoating of the heat shield elements 155, after which the heat shield elements 155 can be reused.

Moreover, a cooling system may be provided for the heat shield elements 155 and/or their holding elements, on account of the high temperatures in the interior of the combustion chamber 110. The heat shield elements 155 are then, for example, hollow and may also have cooling holes (not shown) opening out into the combustion chamber space 154.

Figure 3:
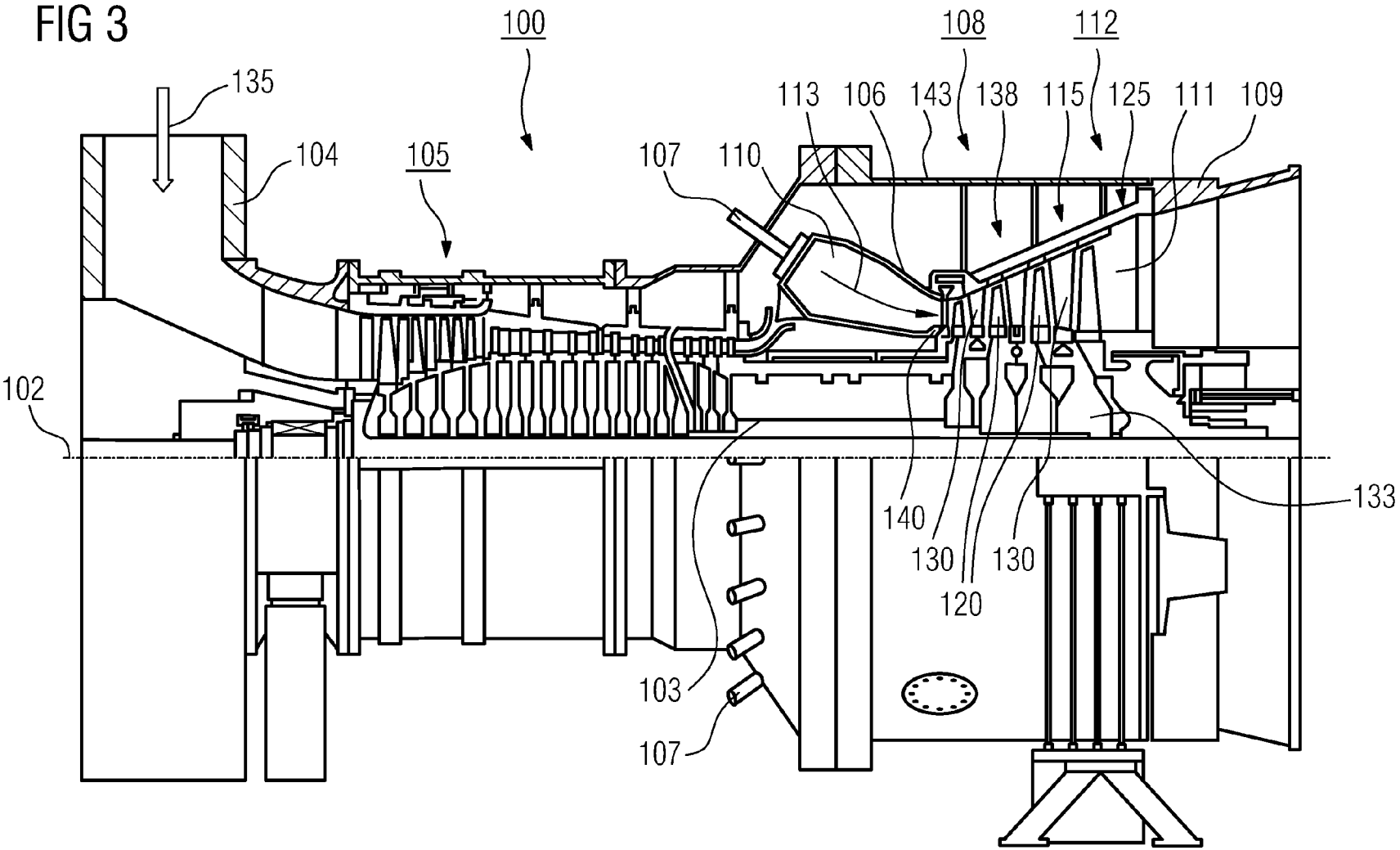
FIG. 3 shows a gas turbine.

FIG. 3 shows, by way of example, a partial longitudinal section through a gas turbine 100.

In the interior, the gas turbine 100 has a rotor 103 with a shaft 101 which is mounted such that it can rotate about an axis of rotation 102 and is also referred to as the turbine rotor.

An intake housing 104, a compressor 105, a, for example, toroidal combustion chamber 110, in particular an annular combustion chamber, with a plurality of coaxially arranged burners 107, a turbine 108 and the exhaust-gas housing 109 follow one another along the rotor 103.

The annular combustion chamber 110 is in communication with a, for example, annular hot-gas passage 111, where, by way of example, four successive turbine stages 112 form the turbine 108.

Each turbine stage 112 is formed, for example, from two blade or vane rings. As seen in the direction of flow of a working medium 113, in the hot-gas passage 111 a row of guide vanes 115 is followed by a row 125 formed from rotor blades 120.

The guide vanes 130 are secured to an inner housing 138 of a stator 143, whereas the rotor blades 120 of a row 125 are fitted to the rotor 103 for example by means of a turbine disk 133.

A generator (not shown) is coupled to the rotor 103.

While the gas turbine 100 is operating, the compressor 105 sucks in air 135 through the intake housing 104 and compresses it. The compressed air provided at the turbine-side end of the compressor 105 is passed to the burners 107, where it is mixed with a fuel. The mix is then burnt in the combustion chamber 110, forming the working medium 113. From there, the working medium 113 flows along the hot-gas passage 111 past the guide vanes 130 and the rotor blades 120. The working medium 113 is expanded at the rotor blades 120, transferring its momentum, so that the rotor blades 120 drive the rotor 103 and the latter in turn drives the generator coupled to it.

While the gas turbine 100 is operating, the components which are exposed to the hot working medium 113 are subject to thermal stresses. The guide vanes 130 and rotor blades 120 of the first turbine stage 112, as seen in the direction of flow of the working medium 113, together with the heat shield elements which line the annular combustion chamber 110, are subject to the highest thermal stresses.

To be able to withstand the temperatures which prevail there, they may be cooled by means of a coolant.

Substrates of the components may likewise have a directional structure, i.e. they are in single-crystal form (SX structure) or have only longitudinally oriented grains (DS structure).

By way of example, iron-based, nickel-based or cobalt-based superalloys are used as material for the components, in particular for the turbine blade or vane 120, 130 and components of the combustion chamber 110.

Superalloys of this type are known, for example, from EP 1 204 776 B1, EP 1 306 454, EP 1 319 729 A1, WO 99/67435 or WO 00/44949.

The blades or vanes 120, 130 may likewise have coatings protecting against corrosion (MCrAlX; M is at least one element selected from the group consisting of iron (Fe), cobalt (Co), nickel (Ni), X is an active element and stands for yttrium (Y) and/or silicon, scandium (Sc) and/or at least one rare earth element, or hafnium). Alloys of this type are known from EP 0 486 489 B1, EP 0 786 017 B1, EP 0 412 397 B1 or EP 1 306 454 A1.

It is also possible for a thermal barrier coating to be present on the MCrAlX, consisting for example of $ZrO_2$, $Y_2O_3$—$ZrO_2$, i.e. unstabilized, partially stabilized or fully stabilized by yttrium oxide and/or calcium oxide and/or magnesium oxide.

Columnar grains are produced in the thermal barrier coating by suitable coating processes, such as for example electron beam physical vapor deposition (EB-PVD).

The guide vane 130 has a guide vane root (not shown here), which faces the inner housing 138 of the turbine 108, and a guide vane head which is at the opposite end from the guide vane root. The guide vane head faces the rotor 103 and is fixed to a securing ring 140 of the stator 143.

The alloy according to the invention comprises the following contents in % by weight:

| | |
|---|---|
| chromium (Cr) | 9.0 to 15.0, |
| in particular | 9.0 to 15.0, |
| titanium (Ti) | 2.0 to 6.0, |
| in particular | 2.0 to 6.0, |
| molybdenum (Mo) | 1.0 to 3.0, |
| tungsten (W) | 2.0 to 6.0, |
| tantalum (Ta) | 3.0 to 7.0, |
| aluminum (Al) | 2.0 to 6.0, |
| cobalt (Co) | 6.0 to 11.0, |
| boron (B) | 0.0025 to 0.05, |
| carbon (C) | 0.01 to 0.3, |

and at least one element selected from the group consisting of silicon (Si), iron (Fe), vanadium (V), niobium (Nb), copper (Cu), hafnium (Hf), zirconium (Zr), phosphorus (P), sulfur (S) and manganese (Mn). This list is not conclusive.

It is preferable for the superalloy to comprise (in % by weight):

| | |
|---|---|
| chromium (Cr) | 11.0 to 13.0, |
| in particular | 11.6 to 12.7, |
| titanium (Ti) | 3.5 to 4.5, |
| in particular | 3.9 to 4.25, |
| molybdenum (Mo) | 1.65 to 2.15, |
| tungsten (W) | 3.5 to 4.1, |
| tantalum (Ta) | 4.8 to 5.2, |
| aluminum (Al) | 3.4 to 3.8, |
| cobalt (Co) | 8.5 to 9.5, |
| boron (B) | 0.0125 to 0.0175, |
| carbon (C) | 0.08 to 0.1, |
| in particular | 0.09. |

It is possible for further auxiliary elements to be present, such as silicon (Si), iron (Fe), vanadium (V), niobium (Nb), copper (Cu), hafnium (Hf), zirconium (Zr), phosphorus (P), sulfur (S) and manganese (Mn).

Upper limits, but also minimum values, are stipulated for further elements which reduce the grain boundary strength. For silicon, these are min. 0.01% by weight and max. 0.12% by weight. Silicon (Si) increases the oxidation resistance and brings about deoxidization of the melt.

Similarly, the iron content (Fe) must not exceed 0.2% and can be at least 0.014% by weight.

Iron (Fe) is known as a γ' former and nickel substituent.

Silicon and iron also improve the castability. A reduction of these elements would be rather undesired.

The vanadium content (V) is preferably not greater than 75 ppm, and preferably is at least 50 ppm.

The copper content (Cu) can be up to 0.1% by weight, with minimum values of from 0.001% by weight.

The hafnium content (Hf) is similarly preferably not greater than 50 ppm. This is in contrast to the known alloys for alloys for directional solidification having columnar grains, in the case of which hafnium is deliberately added in relatively large proportions in order to stabilize the grain boundaries between the columnar grains.

It has been found that the relatively high boron content (B) has a positive effect on the grain boundary strength, even though boron is used as a melting point depressant.

Similarly, however, the boron content must not exceed a certain maximum value, since otherwise a negative effect would result on account of the melting point depressant.

The boron content is preferably 150 ppm.

The niobium content (Nb)—deliberately added in the case of some Ni superalloys—in this case can be up to 75 ppm, with minimum values of 50 ppm.

Optimum carbide formation is achieved with 0.09% carbon (C).

In contrast to the known DS alloys, the addition of relatively high amounts of grain boundary strengtheners such as hafnium and zirconium is dispensed with.

For this purpose, boron (B) and carbon (C) are added. The carbon content is higher than 0.08% by weight.

By minimizing the grain boundary strengtheners hafnium and zirconium, it is necessary for this reason to pay attention precisely to the observance of the impurities, such as silicon (Si), manganese (Mn), iron (Fe) or copper (Cu).

Impurities in the alloys preferably have a maximum value of 10 ppm.

The sulfur content (S) is at least 0.0003% by weight and at most up to 0.25% by weight. The phosphorus content (P) is at least 0.003% by weight and at most 0.025% by weight.

Although a higher degree of purity of the alloy would be desirable, it is scarcely affordable and often not necessary.

By stipulating permissible ranges of auxiliary elements, it is possible for components 120, 130 to be produced favorably but still with known, good high-temperature properties.

The elements silicon (Si), iron (Fe), phosphorus (P) and sulfur (S) are accepted with preference.

The addition of zinc or tin, in particular of tin (Sn), in the region of 50 ppm, in particular of 100 ppm, improves the mechanical properties of the alloy, because it promotes the γ' formation.

The invention claimed is:

1. A nickel-based superalloy for the directional solidification of components having columnar grains, the superalloy comprising (in % by weight):

| | |
|---|---|
| chromium | 9.0 to 15.0; |
| titanium | 2.0 to 6.0; |
| molybdenum | 1.0 to 3.0; |
| tungsten | 2.0 to 6.0; |
| tantalum | 3.0 to 7.0; |
| aluminum | 2.0 to 6.0; |
| cobalt | 6.0 to 11.0; |
| boron | 0.0025 to 0.05; |
| carbon | 0.01 to 0.3, |

silicon in an amount of at least 0.01% by weight and at most 0.12% by weight, hafnium in an amount of at least 10 ppm and at most 75 ppm, and zirconium in an amount of at least 10 ppm and at most 25 ppm.

2. The superalloy as claimed in claim 1, further comprising iron, wherein the iron content is at least 0.014% by weight and at most 0.2% by weight.

3. The superalloy as claimed in claim 1, further comprising vanadium, wherein the vanadium content is at least 50 ppm and at most 75 ppm.

4. The superalloy as claimed in claim 1, further comprising niobium, wherein the niobium content is at least 50 ppm and at most 75 ppm.

5. The superalloy as claimed in claim 1, further comprising copper, wherein the copper content is at least 0.001% and at most 0.1% by weight.

6. The superalloy as claimed in claim 1, further comprising manganese, wherein the manganese content is at least 0.001% and most 0.12% by weight.

7. The superalloy as claimed in claim 1, wherein the boron content is 150 ppm.

8. The superalloy as claimed in claim 1, further comprising phosphorous, wherein the phosphorus content is at least 0.003% and at most 0.015% by weight.

9. The superalloy as claimed in claim 1, further comprising sulfur, wherein the sulfur content is at least 0.0003% and at most 0.025% by weight.

10. The superalloy as claimed in claim 1, wherein the superalloy comprises (in % by weight):

| | |
|---|---|
| chromium | 11.0 to 13.0, |
| titanium | 3.5 to 4.5, |
| molybdenum | 1.65 to 2.15, |
| tungsten | 3.5 to 4.1, |
| tantalum | 4.8 to 5.2, |
| aluminum | 3.4 to 3.8, |
| cobalt | 8.5 to 9.5, |
| boron | 0.0125 to 0.0175, and |
| carbon | 0.08 to 0.1. |

11. The superalloy as claimed in claim 10, wherein the superalloy further comprises at least two elements selected from the group consisting of iron, vanadium, niobium, copper, phosphorus, sulfur and manganese.

12. The superalloy as claimed in claim 10, wherein the superalloy further comprises at least three elements selected from the group consisting of iron, vanadium, niobium, copper, phosphorus, sulfur and manganese.

13. The superalloy as claimed in claim 10, wherein the superalloy further comprises at least four elements selected from the group consisting of iron, vanadium, niobium, copper, phosphorus, sulfur and manganese.

14. The superalloy as claimed in claim 10, wherein the superalloy further comprises at least five elements selected from the group consisting of iron, vanadium, niobium, copper, phosphorus, sulfur and manganese.

15. The superalloy as claimed in claim 10, wherein the superalloy comprises chromium, titanium, molybdenum, tungsten, tantalum, aluminum, cobalt, boron, carbon, silicon, hafnium, zirconium, iron and phosphorus.

* * * * *